US009168729B2

(12) United States Patent
Hieronymus et al.

(10) Patent No.: US 9,168,729 B2
(45) Date of Patent: Oct. 27, 2015

(54) METHOD FOR ENGAGEMENT OF CYLINDERS WITH DIFFERENT REVOLUTION RATES IN CORRECT PHASE AND SHEET-FED ROTARY PRINTING PRESS HAVING THE CYLINDERS

(75) Inventors: Jens Hieronymus, Darmstadt (DE); Alexander Knabe, Heidelberg (DE); Armin Reisinger, Worms (DE); Eckehard Sommer, Dielheim (DE); Jan Teubert, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1248 days.

(21) Appl. No.: 12/463,441

(22) Filed: May 11, 2009

(65) Prior Publication Data

US 2009/0282997 A1 Nov. 19, 2009

(30) Foreign Application Priority Data

May 15, 2008 (DE) ..... 10 2008 023 709

(51) Int. Cl.

| | |
|---|---|
| ***B41F 33/00*** | (2006.01) |
| ***B41F 5/00*** | (2006.01) |
| ***B41F 5/04*** | (2006.01) |
| ***B41F 13/008*** | (2006.01) |
| ***B41F 13/004*** | (2006.01) |
| ***B41F 31/00*** | (2006.01) |

(52) U.S. Cl.

CPC ..... *B41F 13/008* (2013.01); *B41F 13/004* (2013.01); *B41F 31/004* (2013.01); *B41P 2213/70* (2013.01)

(58) Field of Classification Search

CPC .... B41F 13/004; B41F 13/008; B41F 31/004; B41P 2213/70

USPC ..... 101/209, 216, 218, 219, 335, 351, 1, 101/352.01, 483, 484, 247, 248, 337, 349.1

See application file for complete search history.

(56) References Cited

U.S. PATENT DOCUMENTS

| | | | | |
|---|---|---|---|---|
| 5,845,576 | A | 12/1998 | Junghans | |
| 5,983,793 | A | 11/1999 | Volz et al. | |
| 6,041,706 | A * | 3/2000 | Murray | 101/217 |

(Continued)

FOREIGN PATENT DOCUMENTS

| | | | |
|---|---|---|---|
| CN | 1923510 | A | 3/2007 |
| DE | 2103710 | A1 | 8/1972 |

(Continued)

OTHER PUBLICATIONS

German Search Report dated Nov. 14, 2008.

*Primary Examiner* — Blake A Tankersley
*Assistant Examiner* — Marissa Ferguson Samreth
(74) *Attorney, Agent, or Firm* — Laurence A. Greenberg; Werner H. Stemer

(57) ABSTRACT

An apparatus and a method for correct phase engagement of mechanically coupled rotatably drivable components in printing material processing machines, include a coupling for mechanically connecting at least two of the rotatably drivable components. The at least two rotatably drivable components are operated at a different rotational speed in a transmission ratio in a mechanically coupled state, and a control computer has access to the transmission ratio for controlling an engagement operation and taking the transmission ratio into consideration during the correct phase engagement.

14 Claims, 2 Drawing Sheets

(56) References Cited

U.S. PATENT DOCUMENTS

| | | | | |
|---|---|---|---|---|
| 6,393,987 | B1 * | 5/2002 | Bolza-Schunemann et al. | 101/483 |
| 6,546,869 | B1 * | 4/2003 | Eltner et al. | 101/483 |
| 6,672,208 | B2 * | 1/2004 | Bechtler et al. | 101/351.1 |
| 6,758,141 | B1 | 7/2004 | Jentzsch et al. | |
| 6,851,368 | B2 * | 2/2005 | Detmers et al. | 101/483 |

FOREIGN PATENT DOCUMENTS

| | | | | |
|---|---|---|---|---|
| DE | 3124399 | * | 7/1982 | B41F 33/08 |
| DE | 102006036511 | A1 | 3/2007 | |
| DE | 102005060294 | A1 | 6/2007 | |
| EP | 0834398 | A1 | 4/1998 | |
| EP | 0978378 | A2 | 2/2000 | |
| JP | 410446 | A | 9/1992 | |
| JP | 10029300 | A | 2/1998 | |

* cited by examiner

METHOD FOR ENGAGEMENT OF CYLINDERS WITH DIFFERENT REVOLUTION RATES IN CORRECT PHASE AND SHEET-FED ROTARY PRINTING PRESS HAVING THE CYLINDERS

CROSS-REFERENCE TO RELATED APPLICATION

This application claims the priority, under 35 U.S.C. §119, of German Patent Application DE 10 2008 023 709.4, filed May 15, 2008; the prior application is herewith incorporated by reference in its entirety.

BACKGROUND OF THE INVENTION

Field of the Invention

The present invention relates to an apparatus and a method for the correct phase engagement of rotatably drivable mechanically coupled components in printing material processing machines, in which at least two rotatably drivable components can be connected mechanically through a coupling.

In particular, in sheet-fed rotary printing presses, impression cylinders, sheet transport cylinders, plate cylinders and blanket cylinders as well as inking units and dampening units are mechanically coupled in printing units through gearwheel trains. The mechanical coupling of the individual components in the printing units of the printing press is important in printing operation, in order to permit printing with accurate register. Accurate register means that firstly individual color separations are printed exactly above one another and secondly the color separations are printed with a corresponding relative position with respect to an edge of a printed sheet. However, that rigid mechanical coupling during printing operation has disadvantages if a print job change is imminent. During the print job change, rubber blankets have to be washed in the printing units on the blanket cylinders. Moreover, the inks usually have to be changed in the inking units. Furthermore, the rigid mechanical coupling makes the change of the printing plates more difficult during the job change. For that reason, a change has been made to constructing sheet-fed rotary printing presses which, although they are coupled mechanically during printing operation, have a mechanical coupling which can be canceled for the print job change, with the result that individual cylinders and components in the printing press can be driven independently of one another and a plurality of operations can run in parallel independently of one another.

A sheet-fed rotary printing press of that type is known from European Patent Application EP 0 834 398 A1, corresponding to U.S. Pat. No. 5,983,793. In that sheet-fed rotary printing press, the plate cylinders in the printing units can be decoupled in each case from the blanket cylinders. To that end, there is a coupling which can be opened and closed in each printing unit between the plate cylinder and the blanket cylinder. In that way, the mechanical gearwheel train including the transport cylinder and the blanket cylinder can be operated independently of the plate cylinders. In each printing unit, there is a drive motor, by way of which the plate cylinder can be driven independently. In printing operation, however, the couplings are closed and the entire gear train with all of the cylinders in all of the printing units is driven through a main drive motor. The inking units and dampening units are coupled fixedly in each case to the plate cylinders, with the result that the angular positions of the rollers in the inking unit and the dampening unit do not change with respect to the angular positions of the plate cylinders. In order to couple the plate cylinders including the inking unit and the dampening unit into the gearwheel train with the other cylinders again, they have to be positioned in a defined relative position with respect to one another. If that relative position is not correct, the printing quality becomes unusable. For that purpose and in order to position the channels of the adjacent blanket cylinder and plate cylinder correctly with respect to one another, the couplings in the printing units between the plate cylinder and the blanket cylinder are configured as index couplings which make engagement possible in a correspondingly provided position. When that position is reached, the coupling closes and the plate cylinders are again engaged in correct phase with respect to the remaining cylinders.

Furthermore, European Patent Application EP 0 978 378 A2, corresponding to U.S. Pat. No. 6,758,141, has disclosed a method and a device for obtaining an ink profile which is close to continuous printing in the inking unit of a sheet-fed offset printing press. It is possible in that case to decouple the inking unit rollers from the plate cylinder through the use of a double gearwheel which is configured as a coupling. As a result, it is possible for the inking unit to be brought to a standstill while all of the other cylinders, such as plate cylinders, blanket cylinders, impression cylinders and sheet transport cylinders, can rotate independently. As a result of the standstill of the inking unit, idling of the inking unit can be avoided if the printing press is set in operation in a delayed manner. Engagement in correct phase of the inking unit to a defined position of the plate cylinder is provided in order to reengage the inking unit to the drive gear train with the other cylinders.

However, the prior art does not take different rotational speeds of rollers and cylinders in the printing unit of a printing press into consideration. The inking unit rollers and plate or impression cylinders thus usually have different rotational speeds in operation due to gear mechanism transmission ratios. If engagement in correct phase is to take place over the rotating components with different transmission ratios, there is the problem that some components rotate, for example, twice through 360 degrees during the same time that others rotate only once through 360 degrees. That means that the relative angular position of the component which rotates twice as fast with respect to another component which rotates at single speed is not clear over a revolution because one component with a revolution in comparison with the other component passes through an angular position twice. That problem can lead to not all of the rotating components being reengaged into the gearwheel train in their preferential position in correct phase.

SUMMARY OF THE INVENTION

It is accordingly an object of the invention to provide a method for engagement in correct phase of mechanically coupled components which can be driven rotatably and are operated at different rotational speeds in a transmission ratio in a mechanically coupled state or cylinders with different revolution rates, as well as a sheet-fed rotary printing press having the mechanically coupled components or cylinders, which overcome the hereinafore-mentioned disadvantages of the heretofore-known methods and devices of this general type.

With the foregoing and other objects in view there is provided, in accordance with the invention, a method for correct phase engagement of rotatably drivable mechanically coupled components in printing material processing machines. The method comprises mechanically coupling at least two of the rotatably drivable components through a coupling, operating the at least two rotatably drivable components at different rotational speeds in a transmission ratio in a mechanically coupled state, accessing the transmission ratio with a control computer for controlling an engagement operation, and taking the transmission ratio into consideration during the correct phase engagement.

With the objects of the invention in view, there is also provided a sheet-fed rotary printing press, comprising rotatably drivable rollers and cylinders, at least one of the rollers and at least one of the cylinders being drivable at different rotational speeds in a transmission ratio during operation of the printing press, at least one coupling for mechanically coupling the cylinders and rollers, and a control computer accessing the transmission ratio for controlling an engagement operation and taking the transmission ratio into consideration during correct phase engagement.

The method according to the invention and the apparatus according to the invention are suitable, in particular, for use in sheet-fed rotary printing presses. As has already been stated, sheet-fed rotary printing presses have plate cylinders, blanket cylinders and impression cylinders in every printing unit. In addition, there are transport cylinders such as transfer cylinders and turning drums between the printing units. The transport cylinders transport the sheet-shaped printing materials from one printing unit to the next. Furthermore, the printing units have inking units with inking unit rollers which are coupled with different transmission ratios to the cylinders in the printing unit. The different transmission ratios bring about a situation where cylinders and inking unit rollers do not operate at the same rotational speed. However, the relative angular positions of the rollers and cylinders with different transmission ratios are therefore not clear with respect to one another. If, for example, a roller rotates two or three times, the adjacent cylinder rotates only once. According to the present invention, there is then provision for the transmission ratio to be taken into consideration or account during the engagement in correct phase in the case of at least two components which can be driven rotatably. To this end, a control computer of the printing press has access to the respective transmission ratio of the participating components which can be driven rotatably and takes this transmission ratio into consideration during the engagement in correct phase by orienting the cylinders and rollers correspondingly with respect to one another through drive motors and then engaging in correct phase. The corresponding transmission ratios, such as rotational speeds in the ratio 1:2 or 1:3, are often called half-revolution or third-revolution. It is thus possible that some inking unit rollers have half the transmission ratio in comparison with the plate cylinder, while other rollers or the ink ductor have a third of the transmission ratio. This relationship of the inking unit rollers and the ink ductor can not only refer, however, to the plate cylinder, but it can equally well refer to the impression cylinder or other cylinders in the gearwheel train. In most cases, a coupling will be provided which is provided between the plate cylinder and an inking unit roller or between the plate cylinder and the blanket cylinder. Through the use of this switchable coupling, the inking unit rollers and the ink ductor can be decoupled from the plate cylinder and/or blanket cylinder and from the impression cylinder which is coupled to the plate cylinder and/or blanket cylinder.

However, it goes without saying that it is also possible for a plurality of couplings to be provided in a printing unit. For example, an additional coupling can thus be provided between the plate cylinder and the blanket cylinder or between the blanket cylinder and the impression cylinder. The gearwheel train which connects the printing units and has the transport cylinders can also be disengaged by couplings.

A very wide variety of coupling and drive structures is conceivable by way of the cylinders and inking unit rollers such as distributors and ink ductors, and also by way of correspondingly disposed couplings between cylinders and inking unit rollers and/or ink ductors. Each part which can be decoupled preferably has an electric drive motor, by way of which decoupled components can be driven rotatably in an independent manner. In this case, the sheet transport cylinders, such as impression cylinders, transport cylinders and turning drums, are preferably driven jointly by the main drive motor of the printing press. In order to make engagement in correct phase possible, the decoupled drive trains have to be positioned in correct phase with respect to one another through the use of the drive motors, which is monitored and performed by the control computer. To this end, the couplings can be actuated electrically and can be opened and closed by the control computer.

In accordance with another mode of the invention, at least two of the components which can be driven rotatably have sensors for detecting the angular position. In order to permit correct phase engagement of components which can be driven rotatably with different revolution rates, sensors are provided on the components which can be driven rotatably. The relative angular positions of the components which can be driven rotatably with respect to one another can be detected by way of the sensors. The angular sensors can be configured as absolute rotary encoders, with the result that the angular position can also be determined clearly over a plurality of revolutions. The angular position can therefore also be detected and stored exactly at any time for components which can be driven rotatably at half the revolution rate or a third of the revolution rate or other transmission ratios. When the components which can be driven rotatably are reengaged, the components can then be positioned by the drive motors according to the previously stored angular positions and can then be reengaged in correct phase.

It is also possible to use inductive sensors in the rollers with a lower-revolution transmission ratio. The inductive sensors generate a pulse in each case per revolution. The pulse is then processed further by the machine controller. In this way, the sensors generate a clear signal change once per revolution, which signal change is then evaluated together with the values of an incremental encoder, for example, on a single-revolution plate cylinder. This results in a $1/6^{th}$ revolution resultant rotating frequency in the case of a third-revolution ink ductor circulation and a half-revolution distributor circulation in relation to the single-revolution plate cylinder. It is also possible in this way to reengage in correct phase components which can be driven rotatably with different transmission ratios.

Each drive train which can be decoupled preferably has at least one angle sensor, by way of which an absolute angular position or relative angular position with respect to a reference component can be determined. All of the sensors are connected to the control computer, in order for it to be possible to control the coupling operation. It is also possible to bring about engagement in correct phase over a plurality of printing units. In this case, the relative angular positions of cylinders and rollers are compared with one another over a plurality of printing units, with the result that cylinders and rollers with different revolution rates can also be engaged in correct phase over a plurality of printing units.

Other features which are considered as characteristic for the invention are set forth in the appended claims.

Although the invention is illustrated and described herein as embodied in a method for engagement of cylinders with different revolution rates in correct phase and a sheet-fed rotary printing press having the cylinders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
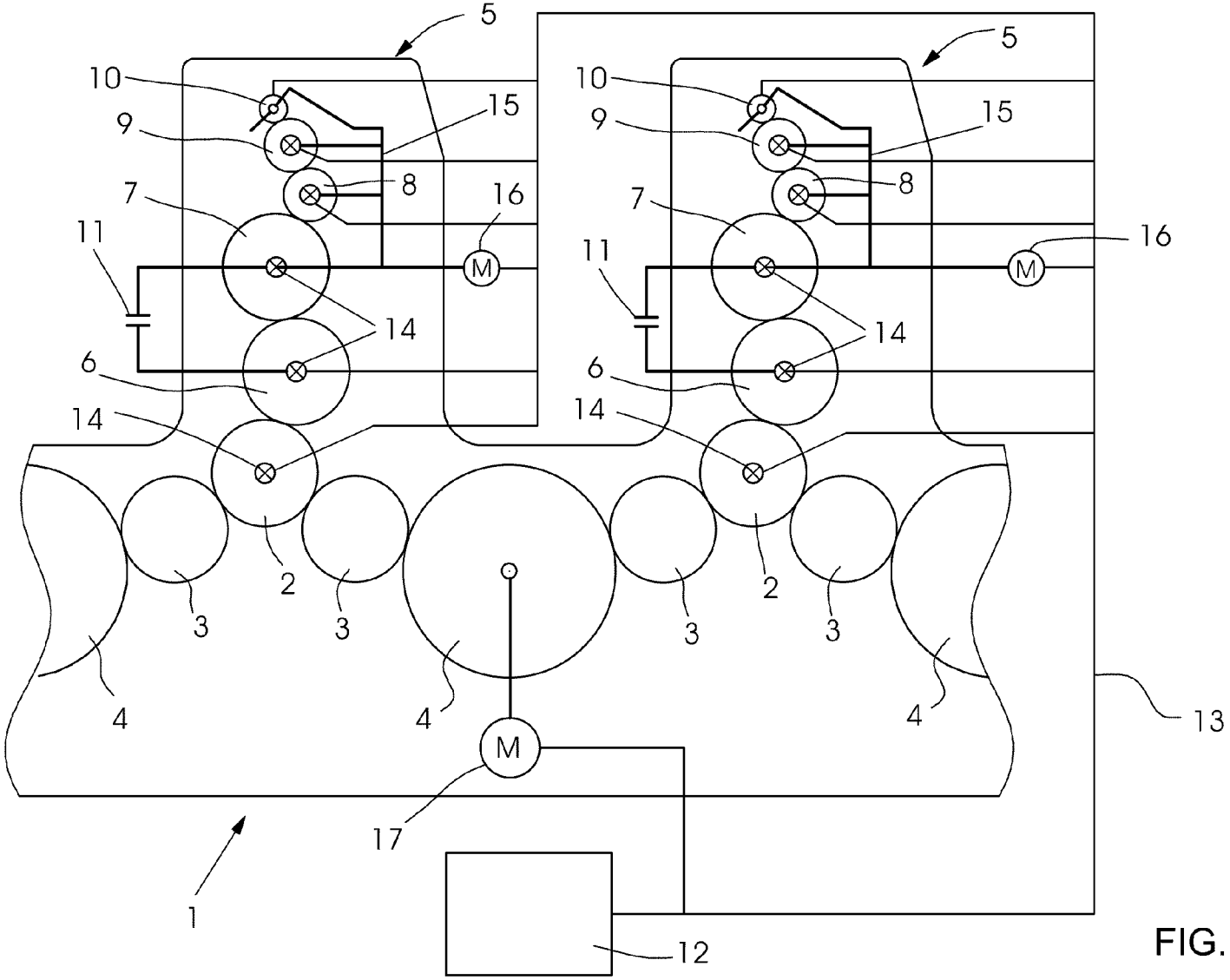
FIG. 1 is a fragmentary, diagrammatic, longitudinal-sectional view of a sheet-fed rotary printing press having two printing units.

Referring now to the figures of the drawings in detail and first, particularly, to FIG. 1 thereof, there is seen a printing press 1 which represents merely one example of a sheet-fed rotary printing press. The invention is independent of the number of printing units, as a result of which two printing units 5 are shown herein, only by way of example. In principle, the printing units 5 are of identical construction, with each printing unit 5 having a plate cylinder 7, a blanket cylinder 6 and an impression cylinder 2. The plate cylinder 7 carries a printing plate with a printing image, while the blanket cylinder 6 has a rubber blanket for transferring the printing image from the plate cylinder 7 onto the printing material. The printing material is printed in a press nip between the impression cylinder 2 and the blanket cylinder 6. The sheet-shaped printing materials are transported by transport cylinders 3 and turning drums 4 from one printing unit 5 to the next printing unit 5. Recto and verso printing on both sides of sheet-shaped printing materials is possible through the use of the turning drums 4. All of the cylinders 2, 3, 4, 6, 7 are coupled mechanically to one another through non-illustrated gearwheels and are driven during printing operation through a common main drive motor 17.

Furthermore, each printing unit 5 has an inking unit including distributor rollers 8, 9 and an ink ductor 10 which removes the ink from a non-illustrated ink fountain. The ink ductor 10 and distributor rollers 8, 9 are likewise connected mechanically to one another. This mechanical coupling takes place through a gear mechanism 15, with the individual components having different transmission ratios than one another. The ink ductor 10 thus has a third-revolution construction, that is to say the plate cylinder 7 performs three revolutions when the ink ductor 10 performs one revolution. In contrast, the first distributor roller 8 has a transmission ratio causing it to rotate 3.85 times during one revolution of the plate cylinder 7. In contrast, oscillating movements of the further distributor rollers 9 are of half-revolution, that is to say the plate cylinder 7 performs two revolutions when the half-revolution distributor roller 9 moves back and forth once. These transmission ratios result from the gear mechanism transmission ratio in the gear mechanism 15. The ink ductor 10 and the rollers 8, 9, which are connected mechanically to one another in this way, can be coupled mechanically to the remaining cylinders 2, 3, 4, 6, 7 through a coupling 11. A mechanical coupling action between the plate cylinder 7 and the blanket cylinder 6 is brought about through the electrically actuable coupling 11. Since the other cylinders are coupled mechanically to the blanket cylinder 6 and the distributor rollers 9, the plate cylinder 7 and the ink ductor 10 are coupled mechanically to the distributor roller 8, closing the coupling 11 brings about complete mechanical coupling of all of the rollers, cylinders and the ink ductor 10 in the sheet-fed printing press 1. As a result, all of the components which are driven rotatably in the printing units 5 are coupled mechanically to one another over the entire printing press 1 and are driven by the common main drive motor 17 during printing operation.

Figure 2:
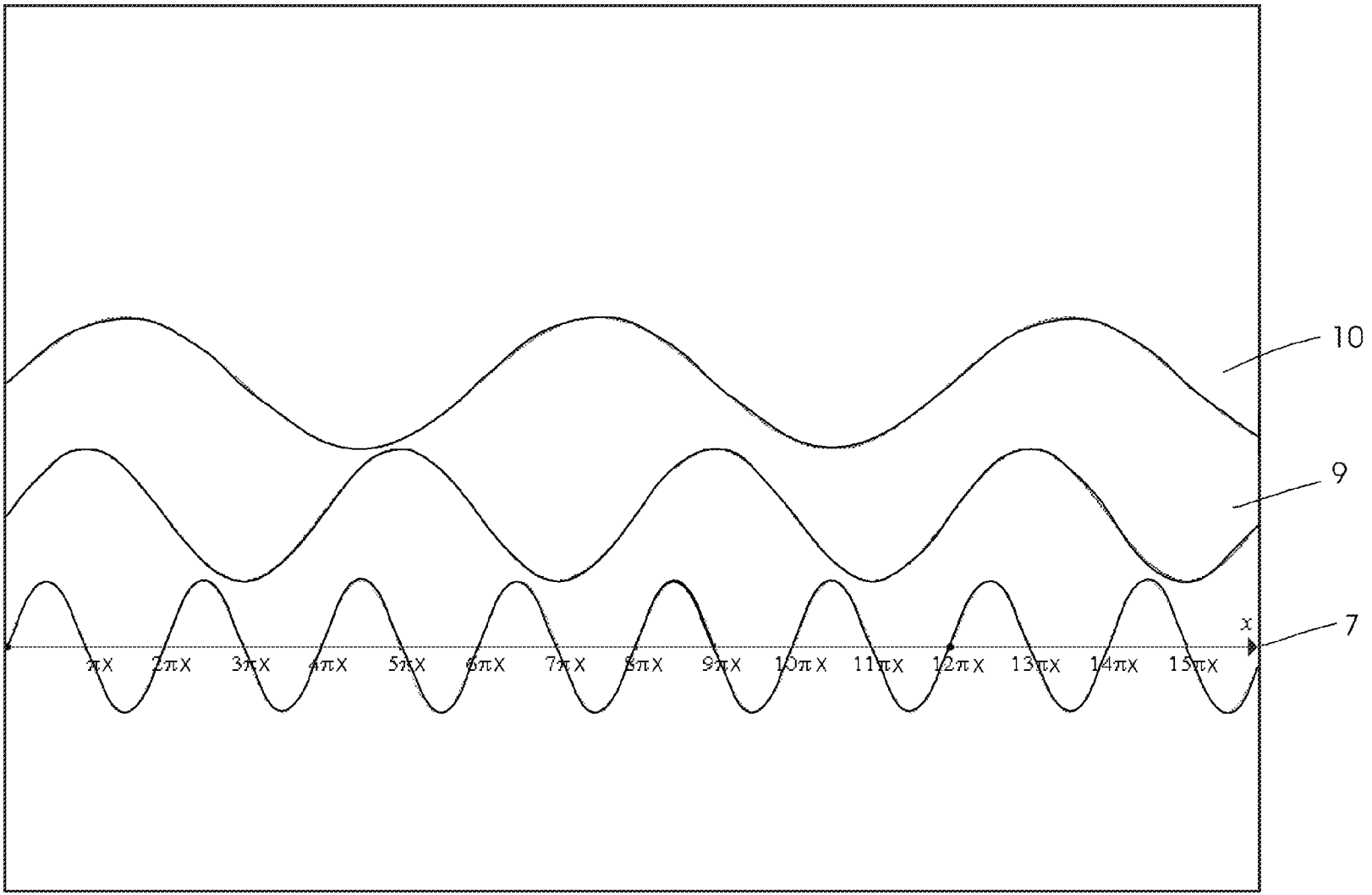
FIG. 2 is a diagram showing a phase profile of a third-revolution ink ductor and a half-revolution distributor roller in relation to a single-revolution plate cylinder.

However, in the case of changeover operations between print jobs, it is appropriate to decouple the inking unit and the plate cylinder 7 from the other cylinders 6, 2, 3, 4 through the use of the electrically actuable coupling 11. As soon as the coupling 11 is open, the rollers 8, 9, the plate cylinder 7 and the ink ductor 10 can rotate with respect to the remaining cylinders 2, 3, 4, 6. If, however, the decoupled inking unit rollers 8, 9, the plate cylinder 7 and the ink ductor 10 are not reengaged in correct phase with respect to the blanket cylinder 6 or impression cylinder 2 before the printing operation, this results in an impairment of the printed image, since all of the rotating components have a preferential position with respect to one another due to tolerance fluctuations in production. The best print quality is delivered in that preferential position. A plurality of sensors 14, which detect the angular position of the respective rotating component, are provided in the printing units in order for it to be possible for the position of the rotating components with respect to one another to be determined and for the engagement in correct phase to be controlled. In one embodiment, sensors 14 are at least provided on the plate cylinder 7, on the ink ductor 10 and on the half-revolution oscillating distributor roller 9. The sensors 14 on the half-revolution oscillating distributor roller 9 and on the third-revolution ink ductor 10 are configured as inductive sensors which generate one pulse per revolution in each case. In contrast, the sensor 14 of the plate cylinder 7 is configured as an incremental encoder. A control computer 12, which can be a constituent part of the printing press 1, detects a clear signal change per revolution of the inductive sensors of the half-revolution oscillating distributor roller 9 and the third-revolution ink ductor 10 and combines that signal with the values of the incremental encoder of the single-revolution plate cylinder 7. In this case, a $1/6^{th}$ revolution resultant circulating frequency results in relation to the single-revolution impression cylinder 7 from the third-revolution ink ductor circulation and the half-revolution distributor circulation. Engagement in correct phase is possible through this circulating frequency, despite different transmission ratios. The signals of the sensors 14 are shown correspondingly in FIG. 2. It can be seen therein that the plate cylinder 7 rotates twice during an oscillating movement of the half-revolution distributor roller 9, and it rotates three times during one circulation of the third-revolution ink ductor 10.

During the synchronous running of the inking unit and the sheet-guiding cylinders 2, 3, 4, 6, 7 in printing operation, the control computer 12 can detect the relative position of the individual rotating components with respect to one another through the resulting $1/6^{th}$ revolution circulating frequency. The detected relative positions are stored in the control computer 12 before leaving the synchronous running by opening the coupling 11.

If the inking unit is to be reengaged into the gearwheel train of the cylinders 2, 3, 4, 6 and washing operations and the plate change are concluded, the positions of the inking unit rollers 8, 9 and of the inking unit ductor 10 as well as of the plate cylinder 7 need to be synchronized again to the gear train. In this case, the relative positions of the plate cylinder 7, distributor rollers 9 and ink ductor 10 which are stored during synchronous running are called up. In this case, the components are positioned through the actuation of electric drive motors 16 on the plate cylinders 7 of the printing press 1 and the main drive motor 17.

Instead of the plate cylinder 7, another cylinder such as the impression cylinder 2 can also be selected as a reference cylinder. In this case, the impression cylinder 2 then has an incremental encoder. The control computer 12 can also equally well evaluate the relative positions with respect to one another over a plurality of printing units 5. Instead of the combination shown herein of incremental encoders and inductive sensors, it goes without saying that it is also possible to embody all of the sensors 14 as incremental encoders which in each case detect corresponding angular positions. Incremental encoders can detect the positions clearly over a plurality of revolutions, as absolute value encoders. The sensors 14 and the drive motors 16, 17 of the printing press 1 are connected to the control computer 12 of the printing press 1 through a communications link 13. A drive for opening and closing the coupling 11 can likewise be actuated by the control computer 12 through the communications link 13, with the result that fully automatic engagement in correct phase as a result of the control computer 12 is possible.

The invention claimed is:

1. A method for correct phase engagement of rotatably drivable mechanically coupled components in printing material processing machines, the method comprising the following steps:

mechanically coupling at least two of the rotatably drivable components through a coupling;

operating the at least two rotatably drivable components at different rotational speeds in a transmission ratio in a mechanically coupled state;

accessing the transmission ratio stored in a control computer for controlling an engagement operation after a previous decoupling; and taking the transmission ratio into consideration during the correct phase engagement.

2. The method according to claim 1, wherein the transmission ratio of the rotatably drivable components is 1:2 or 1:3.

3. The method according to claim 1, which further comprises providing at least three of the rotatably drivable components, driving at least one of the components with a transmission ratio of 1:2 and driving another of the components with a transmission ratio of 1:3.

4. The method according to claim 1, which further comprises providing one of the rotatably drivable components as a blanket cylinder in a printing unit of a printing press, and providing another of the rotatably drivable components as a distributor roller or an ink ductor in an inking unit of the printing press.

5. The method according to claim 1, which further comprises providing one of the rotatably drivable components as an inking unit roller in an inking unit of a printing press, and providing another of the rotatably drivable components as an impression cylinder or plate cylinder in the printing unit of the printing press.

6. The method according to claim 1, which further comprises mechanically coupling the rotatably drivable components through at least one coupling to form a closed gearwheel train.

7. The method according to claim 1, which further comprises driving at least two of the rotatably drivable components independently of one another with respective drive motors.

8. The method according to claim 1, which further comprises providing at least two of the rotatably drivable components with sensors for detecting an angular position thereof.

9. The method according to claim 8, which further comprises driving at least two of the rotatably drivable components independently of one another with respective drive motors, feeding signals of the sensors to the control computer, and actuating the coupling and the drive motors with the control computer during the correct phase engagement using the signals of the sensors.

10. The method according to claim 1, which further comprises detecting relative angular positions of the rotatably drivable components with sensors in an engaged state, storing the relative angular positions in the control computer and, during a reengagement of the rotatably drivable components, moving the rotatably drivable components into the stored relative angular positions and engaging the rotatably drivable components in correct phase in the engaged state.

11. A sheet-fed rotary printing press, comprising:

rotatably drivable rollers and cylinders, at least one of said rollers and at least one of said cylinders being drivable at different rotational speeds in a transmission ratio during operation of the printing press;

at least one coupling for mechanically coupling said at least one of said cylinders and said at least one of said rollers; and a control computer storing and accessing the transmission ratio for controlling an engagement operation after a previous decoupling and taking the transmission ratio into consideration during correct phase engagement.

12. The sheet-fed rotary printing press according to claim 11, which further comprises an inking unit, and a printing unit, said at least one of said rollers being a distributor roller or an ink ductor in said inking unit, and said at least one of said cylinders being a plate cylinder or a blanket cylinder in said printing unit.

13. The sheet-fed rotary printing press according to claim 12, which further comprises a sensor for detecting an angular position of said plate cylinder, and a further sensor for detecting an angular position of said distributor roller or of said ink ductor.

14. The sheet-fed rotary printing press according to claim 11, which further comprises an impression cylinder, a distributor roller or an ink ductor, a sensor for detecting an angular position of said impression cylinder, and a further sensor for detecting an angular position of said distributor roller or of said ink ductor.

* * * * *